US005158432A

United States Patent [19]

Cox

[11] Patent Number: 5,158,432

[45] Date of Patent: Oct. 27, 1992

[54] CENTRIFUGAL BLOWER HOUSING AND METHODS OF FABRICATION

[75] Inventor: Jimmy L. Cox, Greenwood, Ark.

[73] Assignee: Rheem Manufacturing Company, New York, N.Y.

[21] Appl. No.: 755,315

[22] Filed: Sep. 5, 1991

[51] Int. Cl.[5] ..... F04D 29/62

[52] U.S. Cl. ..... 415/214.1; 415/206; 29/513; 29/889.4

[58] Field of Search ..... 415/201, 203, 204, 206, 415/212.1, 214.1; 29/513, 889.4, 888.024; 428/582, 594, 595, 597, 598

[56] References Cited

U.S. PATENT DOCUMENTS

| | | | |
|---|---|---|---|
| 1,190,759 | 7/1916 | Harrington | 29/513 |
| 2,297,948 | 10/1942 | Eisenhauer . | |
| 2,302,095 | 11/1942 | Bartch | 29/899.4 |
| 2,857,665 | 10/1958 | Cohen | 29/513 |
| 2,916,181 | 12/1959 | Pfister et al. . | |
| 3,010,199 | 11/1961 | Smith et al. . | |
| 3,640,556 | 2/1972 | Bennett . | |
| 3,909,918 | 10/1975 | Takizawa et al. . | |
| 3,967,430 | 7/1976 | Knudson . | |
| 4,787,818 | 11/1988 | Bales et al. . | |
| 5,107,579 | 4/1992 | Kostermeier | 29/513 |

FOREIGN PATENT DOCUMENTS

| | | | |
|---|---|---|---|
| 2358214 | 3/1978 | France | 29/513 |
| 72299 | 6/1981 | Japan | 415/214.1 |

*Primary Examiner*—Edward K. Look
*Assistant Examiner*—James A. Larson
*Attorney, Agent, or Firm*—Konneker & Bush

[57] ABSTRACT

The scroll wrap portion of a centrifugal blower housing is joined to the opposite scroll side portions thereof using uniquely configured double tab locking joints spaced apart around the peripheries of the scroll side portions. To form the joints, spaced series of tabs formed along the curved side edges of the scroll wrap are extended outwardly through corresponding peripheral slots in the scroll sides, and are brought into side-by-side adjacency with outwardly projecting tabs formed on the scroll sides at their peripheral slots. Supported series of forming tools positioned outwardly of the opposite scroll sides are forced inwardly against the side-by-side tab pairs in a manner tightly rolling them together to simultaneously form all of the double tab locking joints around both of the scroll side peripheries. The rolled joints mutually interlock portions of each of the scroll sides with adjacent portions of the scroll warp in a manner essentially preventing any appreciably relative movement between the scroll wrap and side portions at their joined areas.

10 Claims, 3 Drawing Sheets

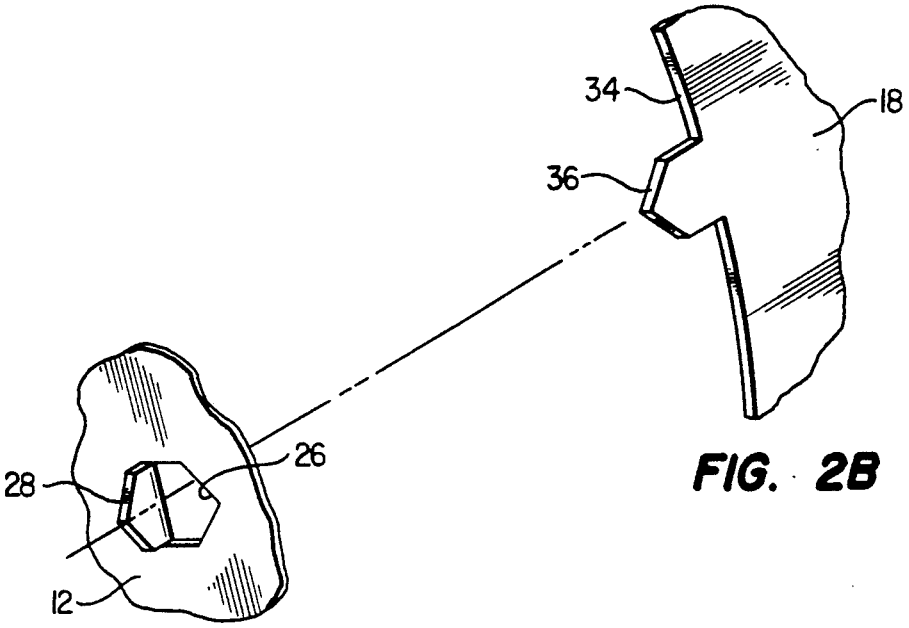
FIG. 2B
FIG. 2A
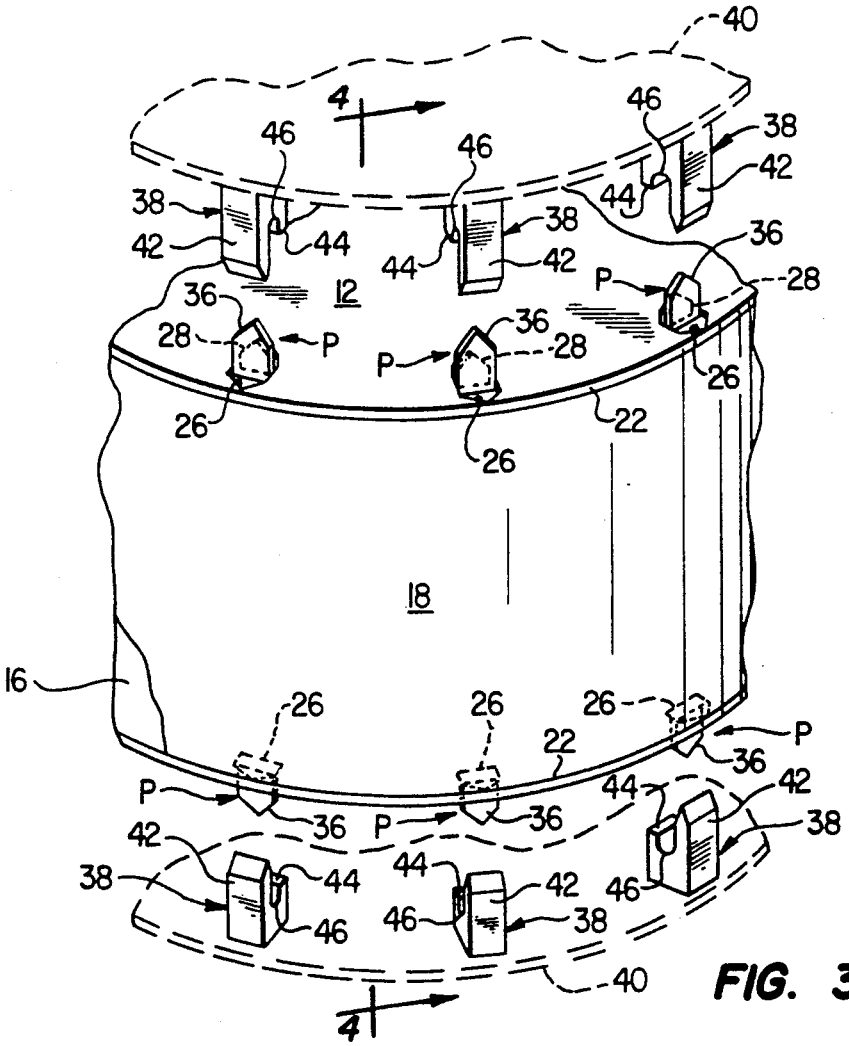
FIG. 3

CENTRIFUGAL BLOWER HOUSING AND METHODS OF FABRICATION

BACKGROUND OF THE INVENTION

The present invention generally relates to material joining methods and apparatus and, in a preferred embodiment thereof, more particularly relates to sheet metal joining techniques used in the fabrication of air blower housings.

Centrifugal blowers of the type used, for example, to flow air through the cabinet of a forced air heating furnace are typically formed from an opposed pair of sheet metal scroll sides positioned against the curved opposite side edges of a sheet metal scroll wrap. A variety of techniques have been used to join the scroll wrap and sides to form the overall blower housing, including the use of spot welding, seam welding, screwing and crimping.

In an attempt to provide a less expensive method of joining the scroll sides to the scroll wrap, various proposals have been made to use tabs, formed on the scroll wrap side edges, as the joining structures. The tabs are inserted outwardly through corresponding slots spaced around the peripheries of the scroll sides, and then bent 90° to interlock the scroll sides and wrap to form the blower housing. U.S. Pat. No. 4,787,818 to Bales et al is illustrative of this conventional tab-and-slot sheet metal joining technique being used in the fabrication of a centrifugal blower housing.

While this transverse bending of the scroll wrap tabs outwardly over the scroll side portions provides a relatively economical alternative to, for example, the use of spot or seam welding techniques, it has two primary disadvantages. First, due to material spring-back, the transversely bent tabs tend to form a relatively loose joint between the scroll sides and the scroll wrap, thereby undesirably permitting a certain degree of shifting between these joined portions of the blower housing. Second, the use of these tabs as joining elements does not lend itself to the automation of the overall joining process. The tabs typically have to be individually bent, thereby significantly lengthening the assembly time for the blower housing.

It can be seen from the foregoing that it would be desirable to provide improved tab look joining methods and apparatus for use in fabricating blower housings and in other joining applications involving adjacent deformable sheet members. It is accordingly an object of the present invention to provide such improved methods and apparatus.

SUMMARY OF THE INVENTION

In carrying out principles of the present invention, in accordance with a preferred embodiment thereof, the curved sheet metal scroll wrap portion of a centrifugal blower housing is secured along its side edges to the opposite sheet metal scroll side portions of the housing using specially designed double tab locking joints.

To form the locking joints, spaced series of outwardly projecting tabs are formed around the voluted peripheries of the roll sides adjacent slots therein, and spaced series of outwardly projecting tabs are formed around the side edge peripheries of the scroll wrap. The scroll wrap tabs are extended outwardly through the scroll side slots and positioned in side-by-side relationships with the scroll side tabs. Each of the side-by-side tab pairs is then deformed to an interlocking, mutually rolled configuration, along the outer side surface of their associated scroll side portion, to form one of the double tab locking joints.

Due to the firm interlock between the rolled tabs in each pair thereof, relative shifting between the interconnected scroll sides and scroll wrap is essentially eliminated. Additionally, the formation of the double tab locking joints lends itself to automation. According to a feature of the present invention, all of the double tab locking joints are simultaneously created using supported series of forming tools positioned on opposite sides of the scroll side portions in outwardly spaced alignment with the side-by-side pairs of tabs projecting outwardly beyond the scroll side portions.

The forming tools are simultaneously forced inwardly against their associated tab pairs and are configured to bendingly deform the tabs in each pair thereof to their final mutually rolled configurations in the locking joint that they form. During this simultaneous formation of all of the locking joints on both sides of the housing, the scroll wrap portion of the housing conveniently provides the backup reactive force against which the forming tools operate to bendingly deform their associated tab pairs.

While the double tab locking joints of the present invention, and their associated formation methods, are representatively illustrated as being utilized in the fabrication of a sheet metal centrifugal blower housing, it will be readily appreciated by those skilled in the joining art that principles of the present invention could also be advantageously utilized in a variety of other deformable sheet member joining applications.

BRIEF DESCRIPTION OF THE DRAWINGS

FIG. 2A is an enlarged scale perspective detail view of the dashed circle area "A" in FIG. 2;

FIG. 2B is an enlarged scale perspective detail view of the dashed circle area "B" in FIG. 2;

FIG. 3 is an enlarged scale fragmentary perspective view of a portion of the blower housing and a series of specially configured tools used to simultaneously form the double tab locking joints therein.

DETAILED DESCRIPTION

Figure 1:
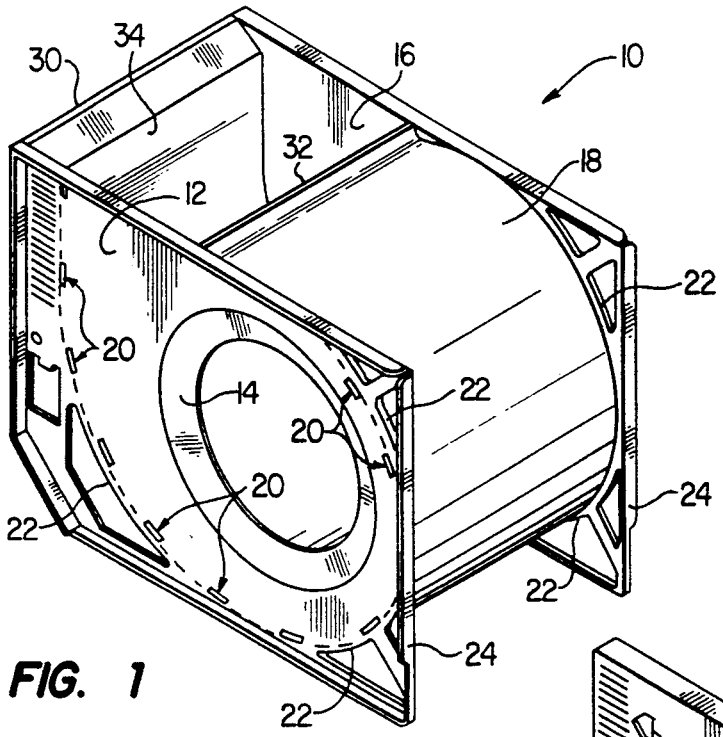
FIG. 1 is a perspective view of a representative centrifugal blower housing having opposite scroll side portions joined to a scroll wrap portion using double tab locking joints incorporating principles of the present invention.

Referring initially to FIGS. and 2, in a preferred embodiment thereof the present invention provides an improved centrifugal blower housing 10. The blower housing 10 is formed from a first sheet metal scroll side member 12 having an inlet opening 14 extending therethrough, a second sheet metal scroll side member 16 positioned in a spaced apart, facing parallel relationship with the side member 12 and having an inlet opening $\mathbf{14}_a$ extending therethrough, and a curved sheet metal scroll wrap member 18 positioned between the side members 12 and 16. As subsequently described, the scroll wrap member 18 is secured to the scroll side members 12,16 by means of spaced series of uniquely constructed double tab locking joints 20 (FIG. 1) positioned on the opposite sides of the blower housing.

Figure 2:
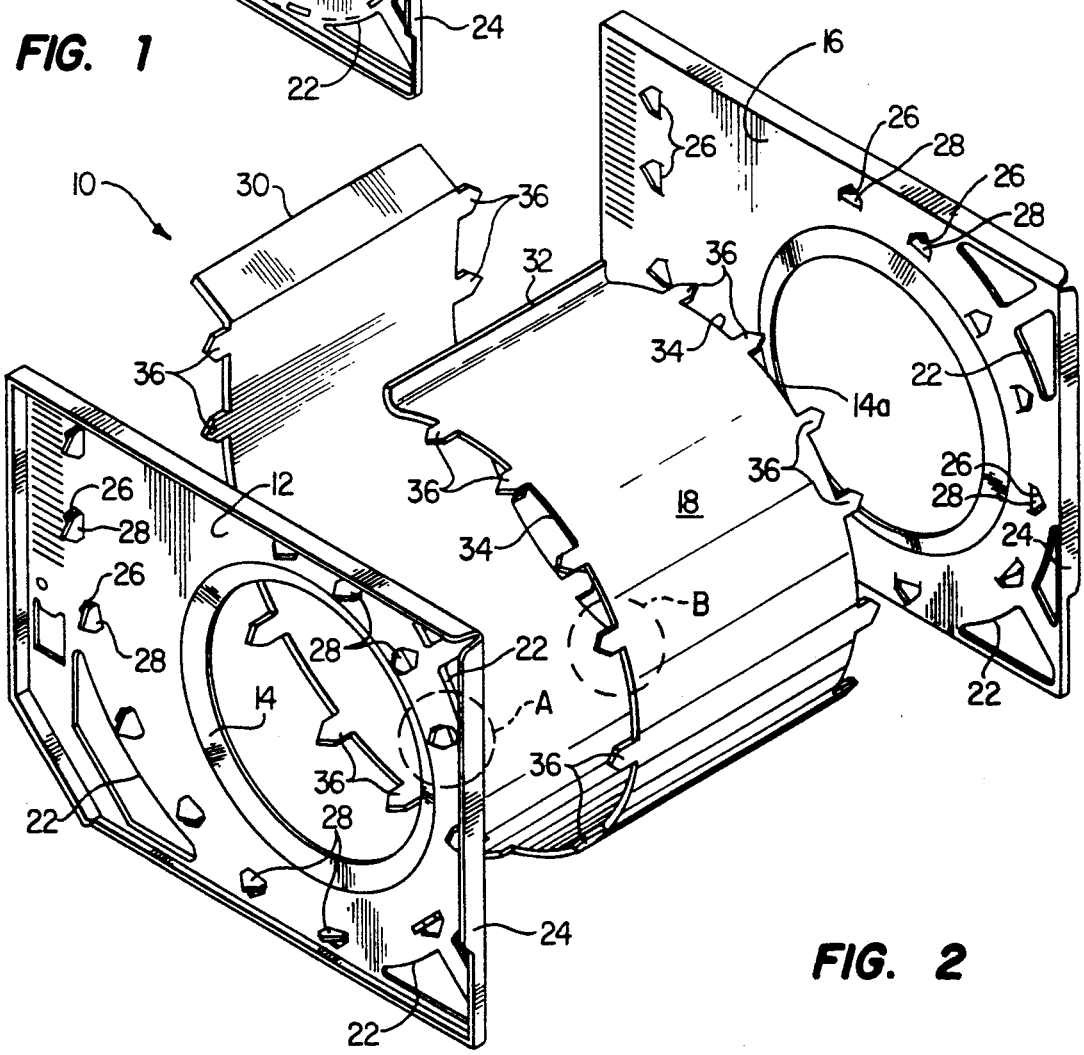
FIG. 2 is a exploded perspective view of the blower housing.

As best illustrated in FIG. 2, the scroll side members 12 and have generally voluted peripheral edge portions 22 outwardly circumscribed by rectangular frame portions 24 that facilitate the installation of the finished blower in, for example, a rectangularly cross-sectioned furnace housing. Spaced series of slots 26 are formed through the scroll side members 12,16 around their peripheral edge portions 22 (see also FIG. 2A). The series of slots 26 are outwardly adjacent and aligned with spaced series of outwardly projecting tabs 28 also formed on the roll side members.

The curved scroll wrap member 18 has an elongated rectangular configuration, a pair of opposite end edges 30,32 which define opposite sides of an outlet opening 34 in the assembled blower housing 10 (FIG. 1), and a pair of opposite side edges 34. Around their lengths, spaced series of tabs 36 project outwardly from the side edges 34, the tabs 36 being somewhat longer than the tabs 28 as may be seen by comparing FIGS. 2A and 2B.

Figure 4B:
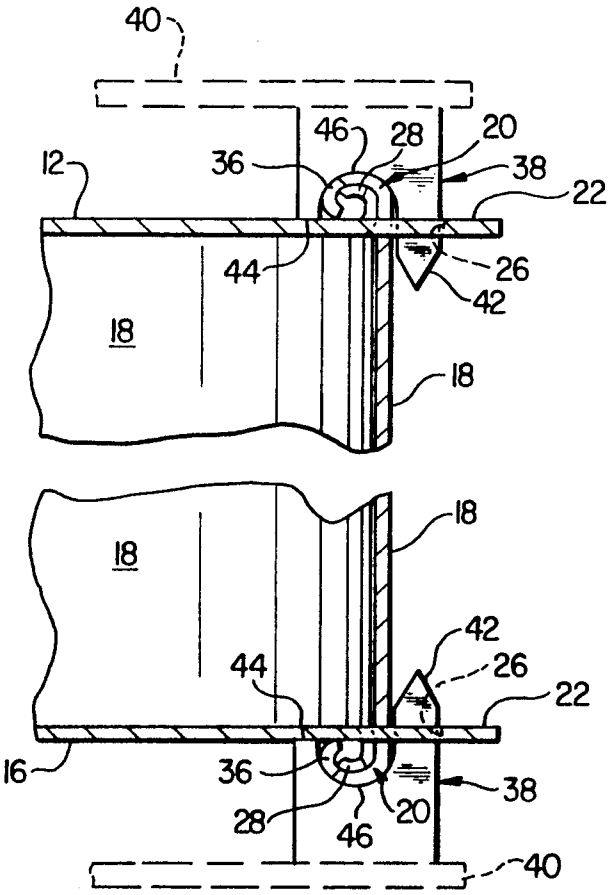
FIGS. 4A and 4B are cross-sectional views through the blower housing, taken along line 4—4 of FIG. 3, and sequentially illustrate the formation of the double tab locking joints.
Figure 4A:
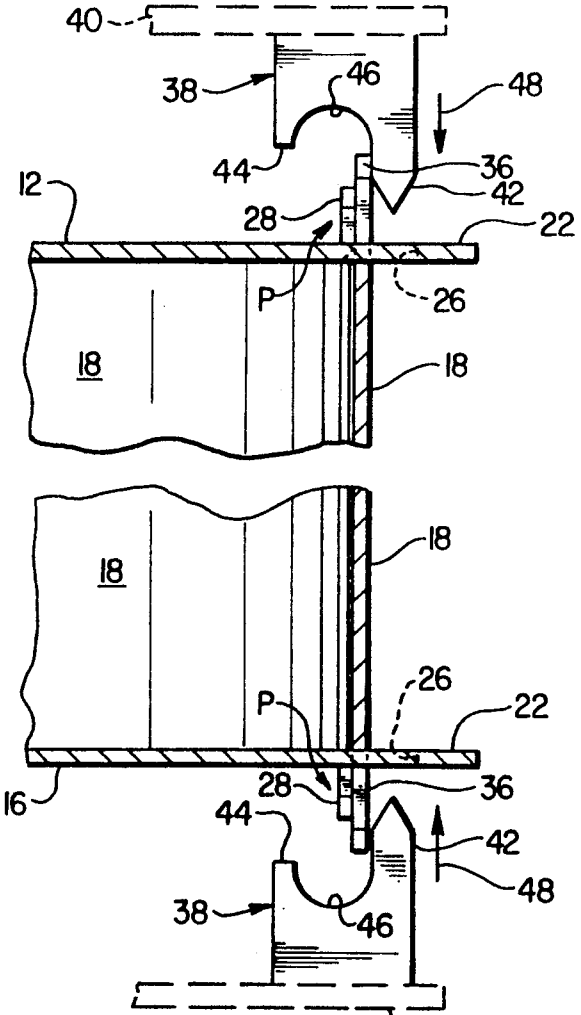

Referring now to FIGS. 3, 4A and 4B, the blower housing 10 is easily and quickly assembled by first holding the scroll wrap member 18, in the desired curved configuration thereof, in a suitable assembly fixture (not illustrated) and extending the scroll wrap member tabs 28 outwardly through the scroll side member slots 26 in a manner positioning circumferentially aligned pairs P of the tabs 28,36 in side-to-side relationships. As illustrated in FIGS. 3 and 4A, each tab pair P projects transversely outwardly from its associated scroll side member, with the tab 36 in each tab pair P extending outwardly beyond its associated tab 28.

According to a feature of the present invention, all of the double tab locking joints 20 are simultaneously created by supporting spaced series of forming tools 38 (on, for example, mounting plates 40) outwardly of the scroll side members 12 and 16, with each of the two series of forming tools in alignment with one of the spaced series of tab pairs P. Each of the forming tools 38 has an elongated, outwardly projecting portion 42 aligned with and insertable inwardly through one of the slots 26, a stop surface 44 inwardly offset from the outer end of portion 42, and an arcuate surface depression 46 positioned between the portion 42 and the to surface 44. As best illustrated in FIG. 4A, the portion 42 of a each tool 38 is positioned on one side of a tab pair P, with the stop surface 44 being positioned on the opposite side of the tab pair.

The members 38 are used to deform the tab pairs P by simultaneously moving the mounting plates 40 inwardly toward the scroll side members which they face, as indicated by the arrows 48 in FIG. 4A, to cause the outer ends of the elongated tool portions 42 to inwardly enter the slots 26 and the tab pairs P to be outwardly engaged by the inset surfaces of the tool surface depressions 46. Further driven movement of the mounting plates 40 toward the scroll side members 12,16 causes the tabs 28,36 in each tab pair P to be bendingly deformed by the inwardly moving surface depressions 46 until the stop surfaces 44 engage the outer side surfaces of the scroll side members 12,16 as shown in FIG. 4B. The forces of this tab deformation process are conveniently resisted in a necessary reactive manner by the scroll wrap member 18 bracingly interposed between the scroll side members 12 and 16.

At this point, the previously straight tabs 28,36 in each of the side-to-side tab pairs P have been bendingly deformed to a mutually rolled configuration, with the tab 36 rolled outwardly around the tab 28, to form the double tab locking joints 20 spaced around the outer sides of the peripheral edge portions 22 of the scroll side members 12,16 and positioned inwardly of the slots 26 as shown in FIG. 4B.

The use of the double tab locking joints 20 of the present invention to secure the scroll wrap member 18 to the opposite scroll side members 12,16 provides an advantageous, reduced cost alternative to conventional interconnection methods such as spot welding, seam welding, crimping and threaded fasteners. Moreover, compared to conventional single bent tab connection techniques, such as that illustrated in the aforementioned U.S. Pat. No. 4,787,818 to Bales et al, the double tab lock joining technique is substantially stronger because the adjacent blower housing members being joined are integrally formed together. This permits the use of a lighter gauge sheet metal to form the scroll wrap and sides.

Additionally, the firmly interlocked tabs 28,36 in each of the rolled tab pairs P essentially precludes undesirable relative movement of the scroll wrap and sides at their joined areas. Moreover, as illustrated and described above, the configuration and orientation of the tab pairs P, as well as the configurations of the completed locking joints 20 substantially facilitates the use of a cost saving automated process to fabricate the blower housing 10.

While the present invention has been illustrated as being utilized in the fabrication of a representative centrifugal blower housing, it will be readily appreciated by those skilled in the joining arts that principles of the present invention could also be advantageously used in the joining of a variety of other types of permanently deformable sheet members in the construction of other types of apparatus.

The foregoing detailed description is to be clearly understood as being given by way of illustration and example only, the spirit and scope of the present invention being limited solely by the appended claims.

What is claimed is:

1. A method of fabricating a centrifugal blower housing, said method comprising the steps of:

providing first and second scroll side members each formed from a permanently deformable sheet material and having an outer side surface and a generally voluted peripheral edge portion;

providing a scroll wrap member formed from a permanently deformable sheet material and having opposite side edges;

forming through each of said first and second scroll side members, around its peripheral edge portion, a spaced series of openings each adjacent to tab potion of the scroll side member projecting generally transversely outwardly from its outer side surface;

forming spaced series of outwardly projecting tabs along each of said opposite side edges of said scroll wrap member;

positioning said scroll wrap member between said first and second scroll side members;

extending the tabs on one side edge of said scroll wrap member outwardly through the openings in said first scroll side member, and the tabs on the other side edge of said scroll wrap member outwardly through the openings in said second scroll side member, to position each scroll wrap member tab in a side-to-side relationship with an associated one of said scroll side member tabs; and fixedly interlocking the scroll side an wrap members by deforming each of their side-to-side tab pairs to a mutually rolled configuration along the outer side of their associated scroll side member, each side-to-side tab pair being deformed by pressing a forming tool inwardly against the tab pair in a direction generally transverse to the outer side surface of the scroll side member from which the tab pair outwardly project, said forming tool having an outer end having an arcuate depression therein positioned adjacent an outwardly projecting portion thereof, said arcuate depression having an inset surface, and said pressing step including the steps of inserting said outwardly projecting portion inwardly through the scroll side member opening associated with the tab pairs and forcibly engaging an outer end portion of the tab pair with the inset surface of said arcuate depression.

2. The method of claim 1 wherein:

said scroll side and wrap member are formed from sheet metal.

3. The method of claim 1 wherein:

said arcuate depression of said forming tool is positioned between said outwardly projecting portion thereof and a stop surface potion thereof, and said pressing step further includes the step of bringing said stop surface into contact with the outer side surface of the scroll side member from which the tab pair outwardly project.

4. A centrifugal blower housing fabricated by the method of claim 1.

5. A centrifugal blower housing fabricated by the method of claim 2.

6. A centrifugal blower housing fabricated by the method of claim 5.

7. A method of fabricating a centrifugal blower housing, said method comprising the steps of:

providing first and second scroll side members each formed from a permanently deformable sheet material and having an outer side surface and a generally voluted peripheral edge portion;

providing a scroll wrap member formed from a preeminently deformable sheet material and having opposite side edges;

forming through each of said first and second scroll side members, around its peripheral edge portion, a spaced series of openings each adjacent a tab portion of the scroll side member projecting generally transversely outwardly from its outer side surface;

forming spaced series of outwardly projecting tabs along each of said opposite side edges of said scroll wrap member;

positioning said scroll wrap member between said first and second scroll side members;

extending the tabs on one side edge of said scroll wrap member outwardly through the openings in said first scroll side member, and the tabs on the other side edge f said scroll wrap member outwardly through the openings in said second scroll side member, to position each scroll wrap member tab in a side-to-side relationship with an associated one of said scroll side member tabs; and fixedly interlocking the scroll side and wrap members by simultaneously deforming each of their side-to-side tab pairs, to mutually rolled configurations along the outer side of their associated scroll side member, by the steps of:

supporting a first spaced series of forming tools in an aligned, outwardly spaced relationship with the tab pairs projecting outwardly from said first scroll side member, supporting a second spaced series of forming tools in an aligned, outwardly spaced relationship with the tab pairs projecting outwardly from said second scroll side member, and simultaneously pressing the supported first and second spaced series of forming tools against their associated tab pairs in a direction generally transverse to the first and second scroll side members, each of said forming tool having an outer end having an arcuate depression therein positioned adjacent an outwardly projecting portion thereof, each of said arcuate depressions having an inset surface, and said simultaneously pressing step including the steps of inserting said outwardly projecting portions inwardly through said scroll side member openings and forcibly engaging outer end portions of the tab pairs with the inset surfaces of said arcuate depressions.

8. The method of claim 7 wherein:

the arcuate depression in each of said forming tools is positioned between the outwardly projecting portion of the tool and a stop surface thereof, and said simultaneously pressing step further includes the step of bringing said stop surfaces into contact with the scroll side members.

9. A centrifugal blower housing fabricated by the method of claim 8.

10. A centrifugal blower housing fabricated by the method of claim 7.

* * * * *

UNITED STATES PATENT AND TRADEMARK OFFICE

CERTIFICATE OF CORRECTION

PATENT NO. : 5,158,432
DATED : October 27, 1992
INVENTOR(S) : Jimmy L. Cox

It is certified that error appears in the above-indentified patent and that said Letters Patent is hereby corrected as shown below:

Abstract, line 17, "warp" should be --wrap--.
Column 1, line 46, "look" should be --lock--.
Column 1, line 62, "roll" should be --scroll--.
Column 2, line 41, "a" should be --an--.
Column 2, line 57, "FIGS. and 2" should be --FIGS. 1 and 2--.
Column 3, line 5, "12 and have" should be --12 and 16 have--.
Column 3, line 14, "roll" should be --scroll--.
Column 3, line 47, "the to surface" should be --the stop surface--.
Column 4, line 56, "adjacent to tab" should be --adjacent a tab--.
Column 5, line 4, "side an wrap" should be --side and wrap--.
Column 5, line 20, "tab pairs" should be --tab pair--.
Column 5, line 24, "member" should be --members--.
Column 5, line 29, "potion" should be --portion--.
Column 5, line 47, "from a preeminently deformable" should be --from a permanently deformable--.
Column 6, line 9, "edge f" should be --edge of--.
Column 6, line 32, "forming tool" should be --forming tools--.

Signed and Sealed this

Thirty-first Day of March, 1998

*Attest:*

*Attesting Officer*

BRUCE LEHMAN

*Commissioner of Patents and Trademarks*